United States Patent [19]

McKeown

[11] Patent Number: 4,916,826

[45] Date of Patent: Apr. 17, 1990

[54] STENCIL FOR HANDPRINTING EQUALLY SPACED, ACCURATELY ALIGNED CHARACTERS

[76] Inventor: John L. McKeown, 53, Dunlambert Park, Belfast, United Kingdom, BT15 3NL

[21] Appl. No.: 75,750

[22] PCT Filed: Oct. 20, 1986

[86] PCT No.: PCT/GB86/00641

§ 371 Date: Aug. 19, 1987

§ 102(e) Date: Aug. 19, 1987

[87] PCT Pub. No.: WO87/02315

PCT Pub. Date: Apr. 23, 1987

[30] Foreign Application Priority Data

Oct. 21, 1985 [GB] United Kingdom ..... 8525872

[51] Int. Cl.[4] ..... B43L 13/20

[52] U.S. Cl. ..... 33/564; 434/164

[58] Field of Search ..... 33/562, 563, 564, 565, 33/467, 477; 101/407 BP, 327, 103, 112; 434/164

[56] References Cited

U.S. PATENT DOCUMENTS 1,022,384 4/1912 Bahr ..... 33/564
2,298,635 10/1942 Bliss ..... 33/564 X
3,242,577 3/1966 Murphy ..... 33/564
3,584,385 6/1971 Booth ..... 33/564

*Primary Examiner*—William A. Cuchlinski, Jr.
*Assistant Examiner*—Christopher W. Fulton
*Attorney, Agent, or Firm*—Pravel, Gambrell, Hewitt, Kimball & Krieger

[57] ABSTRACT

A precision coding device comprises a movable unit (11) and a base unit (10) having co-operating means (33, 20, 21) to hold the former on the latter rigidly but detachably in any one of a plurality of equally spaced positions. The movable unit (11) has very few character apertures (26)—preferably only one aperture—which alone permits manual formation of all thirty-six alphanumeric characters, simply by inverting and/or rotating it using a twirler (32). The base unit has a lower (12) and an upper member (13) joined together along two or three edges leaving a space therebetween for matter to be handprinted, e.g., an envelope. The upper member has therein an opening (19) providing a writing path and longitudinal rows of equally spaced vertical recesses (21) in two parallel walls (18), and/or slots (20) to receive their counterparts in/on the movable unit (11), thereby ensuring precision and accuracy in placement, registration, alignment and spacing of characters identical in height and width which is an object of the device.

32 Claims, 5 Drawing Sheets

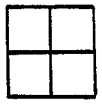
FIG. 1
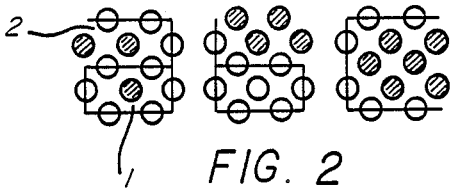
FIG. 2
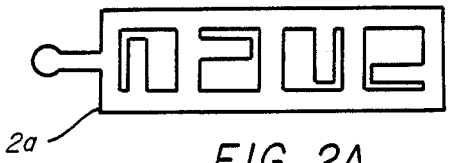
FIG. 2A
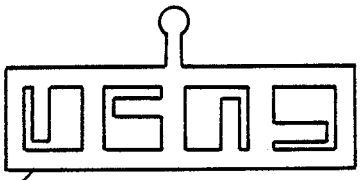
FIG. 2B
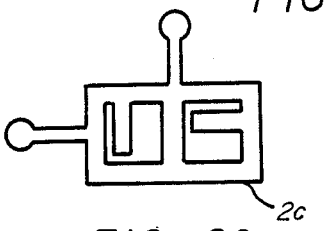
FIG. 2C
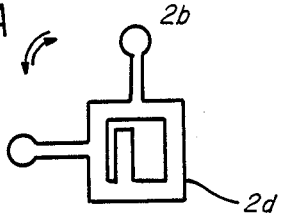
FIG. 2D
FIG. 3A
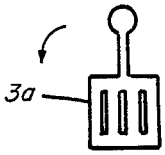
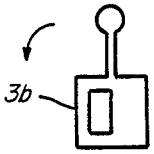
FIG. 3B
FIG. 3C
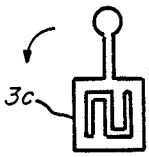
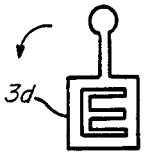
FIG. 3D
FIG. 3E
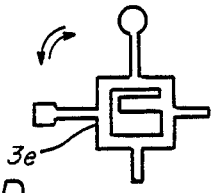
FIG. 4
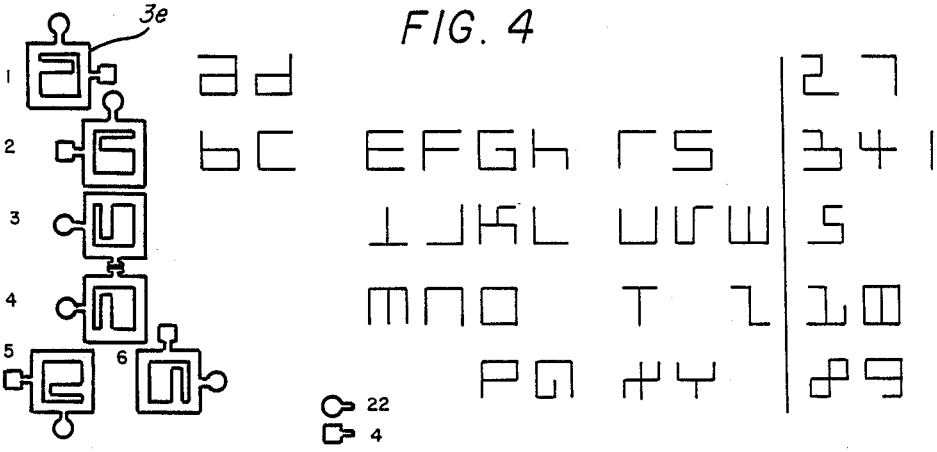

FIG. 5
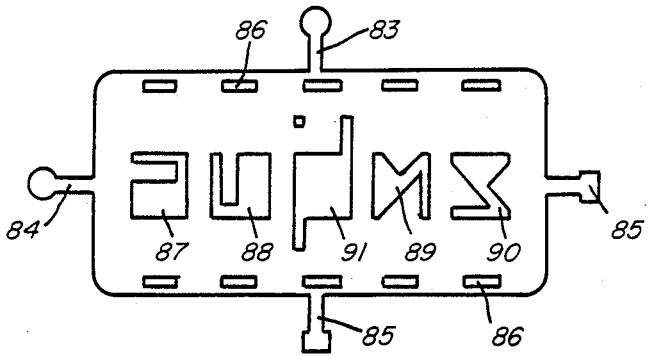
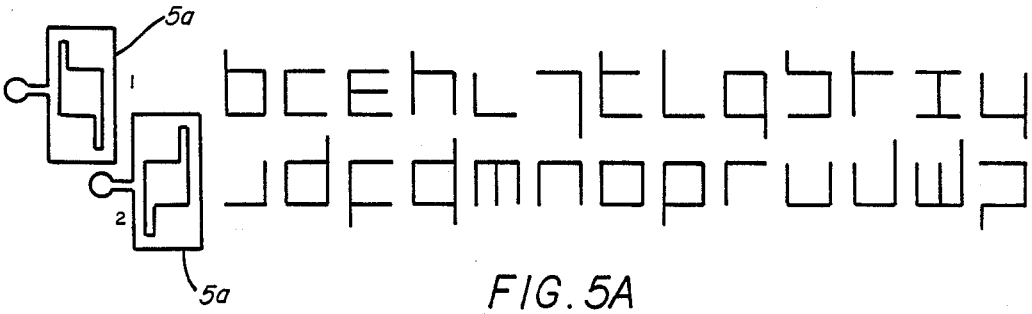
FIG. 5A
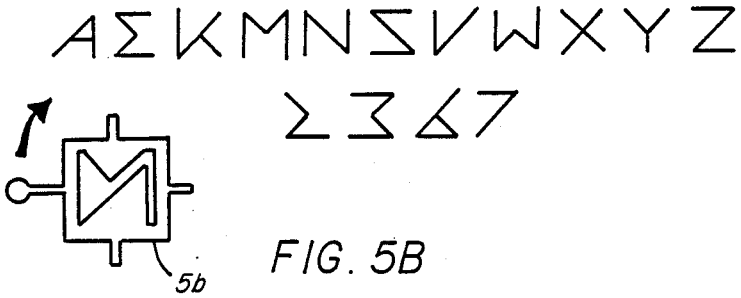
FIG. 5B
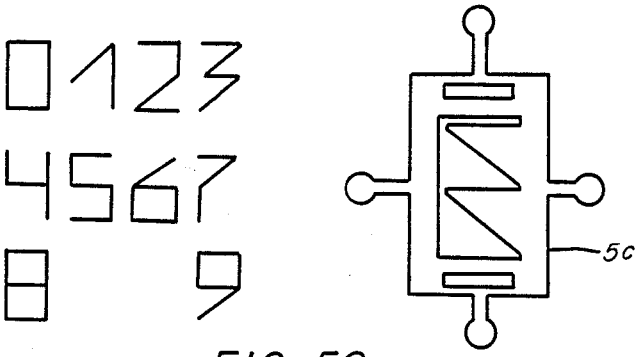
FIG. 5C

FIG. 8
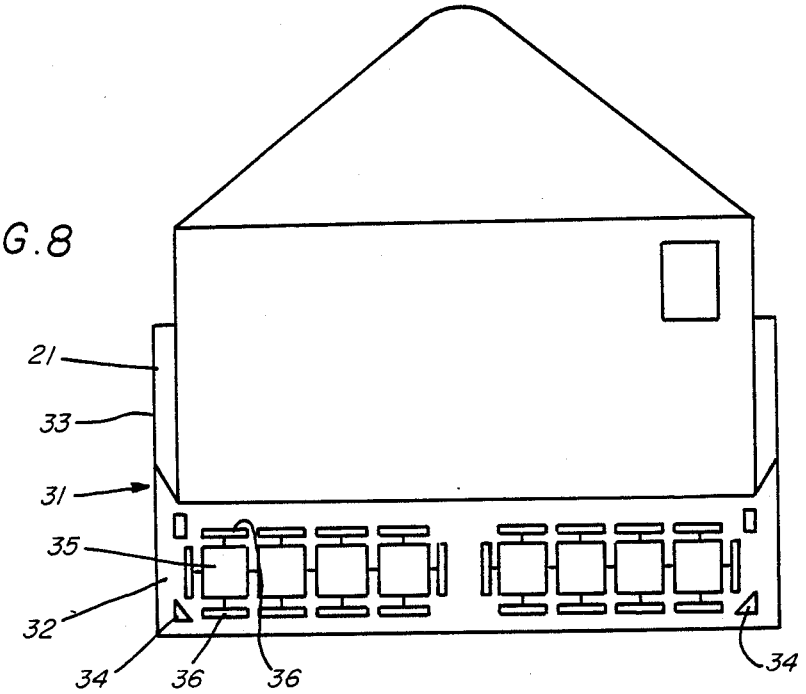
FIG. 8A
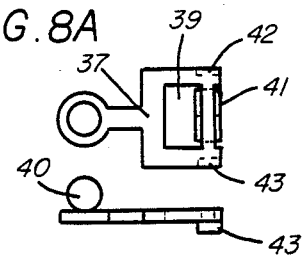
FIG. 8B
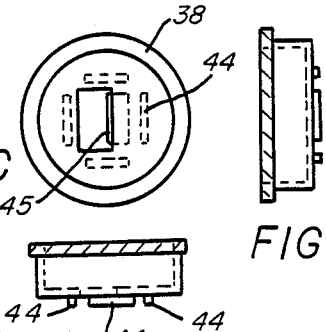
FIG. 8C
FIG. 8D
FIG. 8E
FIG. 9
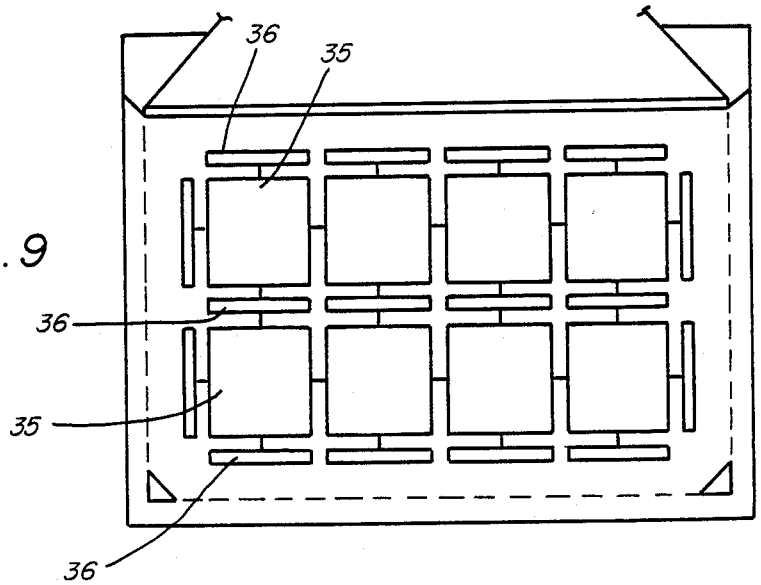

STENCIL FOR HANDPRINTING EQUALLY SPACED, ACCURATELY ALIGNED CHARACTERS

This invention relates to a precision handprint coding device.

Even after more than half-a-century of intensive, competitive research and development by the largest electronic and other organizations at massive expenditure worldwide, no satisfactory means, method or device appears yet to have emerged capable of providing the unusually high standard of handprint essential for immediate, accurate, automatic machine reading or recognition (OCR) of handprint by simple means.

Such a capability was considered so important by the Government in the sixties as to result in the funding of a special project at NPL under the leadership of the late Dr. Chris Evans, who with Mr. Epps from The London College of Printing, evolved so successfully the Epps-Evans (E-E) alphanumeric stylized font of characters. This is still considered the ideal from every angle for such OCR, provided it could be handprinted by the general public to the demanding standards of precision and accuracy not only in height and width, but also as regards placement, alignment, orientation, without adjacent characters touching or overlaying (often found in typed and office print) and spacing - consistently without deviation therefrom.

It is therefore an object of this invention to provide a handprint coding device which is simple, convenient, easily operated, inexpensive and compact not only to attain required standards, but also, in particular, to prevent imprecise placement, misalignment, varying orientation, irregular or inaccurate spacing or characters touching or overlaying, or deviations of any kind, even in the hands of remote, or isolated, inexperienced people generally.

A handprint stencil comprising:

a base unit including an opening or openings providing a writing path;

a generally planar movable unit provided with at least one multi-character, complete font, single aperture;

a generally planar area of said base unit, situated adjacent to said opening, to receive said movable unit; and a plurality of mating connections on said base unit and said movable unit to detachably and releasably secure said movable unit firmly and substantially immovably in any direction parallel to the plane of said planar area in any one of a plurality of positions and any one of a plurality of orientations on the said generally planar area of said base unit, said mating connections on said base and movable units being provided with abutment walls extending perpendicularly to the plane of the generally planar area and to the plane of the movable unit respectively, to permit movement of said movable unit into and out of engagement with said base unit only in a direction substantially perpendicular to the plane of said generally planar area of said base unit;

whereby said movable unit is detachably held on said planar area of said base unit by said mating connections to allow a complete font to be stenciled by means of said multi-character, single aperture of said movable unit and through said opening of said base unit onto matter to be stenciled.

To facilitate such orientation, e.g. turning over, the movable unit may be provided with one or more projections, for example, including stems projecting from the edges of the movable unit, by means of which the movable unit may be readily held between a finger and thumb externally, picked up and turned over, rotated, or otherwise orientated; and/or rotated by projections from its top surface.

Preferably, the base unit comprises a lower member for supporting matter to be printed and an upper member for holding the movable unit separate from the matter to be printed, the upper member being supported by and disposed above the lower member to leave a space between the members sufficient to accommodate matter to be printed, the writing path(s) and the cooperating means of the base unit being in/on the upper member.

Various ways may be used to hold the movable unit rigidly in position on the base unit to ensure that the printing is positioned with such accuracy on the matter to be printed so that, for example, reliable OCR can be performed on the printing with uninterrupted speed and accuracy. For optimum results, all or a selected number of such ways may be used in combination. Suitable ways are as follows:

1. Mortice and tenon connections may be provided between the movable unit and the base unit. Thus the movable unit may be provided on one or both sides, with studs or ridges which are inserted in corresponding holes or slots, respectively, in the base unit to connect the movable unit to the base unit, at least some of the holes or slots being located along the borders of the writing path and at least some of the studs or ridges being located on the movable unit bordering the character opening(s) whereby, when the studs or ridges are inserted in the holes or slots, the or each character aperture is located with precision above the writing path. Sufficient connections may be provided at appropriate precisely spaced intervals in the base unit to permit a succession of firm positions of the movable unit above the writing path. While the arrangement of studs or ridges on the movable unit and holes or slots in the base unit is preferred for ease of location of the movable unit on the upper member, the converse arrangement of holes or slots in the movable unit and studs or ridges on the base unit may be used if desired.

2. Projections on the edges of the movable unit may be firmly located in recesses, such as vertical slots, in the base unit, the recesses being accurately spaced and disposed on opposite sides of the writing path. Preferably each of the slots is shaped to guide the corresponding projections into the bottom of the slot where it is firmly located, for example the slots may be substantially Y-shaped. Again, sufficient recesses may be provided at appropriate equally spaced intervals in the base unit to permit the movable unit to be firmly located in each of a succession of positions above the writing path. Where this arrangement is combined with that in the preceding paragraph, the recesses for the projections of the movable unit may be disposed in the base unit outwardly of some of the tenon and mortice connections and inwardly of other mortice and tenon connections.

3. The movable unit may fit in a flat-based longitudinal trough in the base unit, the edges of the movable unit abutting the sides of the trough. In this case, the upper edges of the two sides of the trough, facing each other across the writing path, may be inclined to guide the movable unit down into the bottom of the trough. This way of holding the movable unit would normally be combined with way 1 and/or way 2 above. In this connection, some at least of the mortice and tenon connections could be made on the base of the trough and the vertical slots or recesses for the stems of the movable unit could be located in the walls of the trough. The writing path should be located in the flat base of the trough with sufficient border to the writing path to provide not only adequate support for the movable unit on the base of the trough but also adequate accommodation for the mortice and tenon connections.

In a preferred handprint coding device of the invention, all three of these ways may be combined to hold the movable unit securely in position on the base unit.

So that OCR (optical character recognition) can be performed on the printing, it is usual to provide "start" and "end" calibration marks on the printed matter, e.g. an envelope carrying a printed post code, to facilitate machine reading of the print. To enable such marks to be made, the base unit or upper member thereof may be provided with slots or other cut-outs appropriately positioned with respect to the writing path, for example at the ends of the writing path. Further slots or other cut-outs may be provided in the upper member for viewing purposes to enable the user to ensure that the matter to be printed, e.g. an envelope, is fully inserted in the space between the upper and lower members of the base unit and correctly positioned for printing.

The invention will now be further described by way of example with reference to the accompanying drawings, in which:

FIG. 1 illustrates a grid on which the complete Epps-Evans (E-E) alphabetical and numerical font, is based;

FIG. 2 illustrates how lettering formed from the grid of FIG. 1 may be read by an OCR machine;

Figure 6:
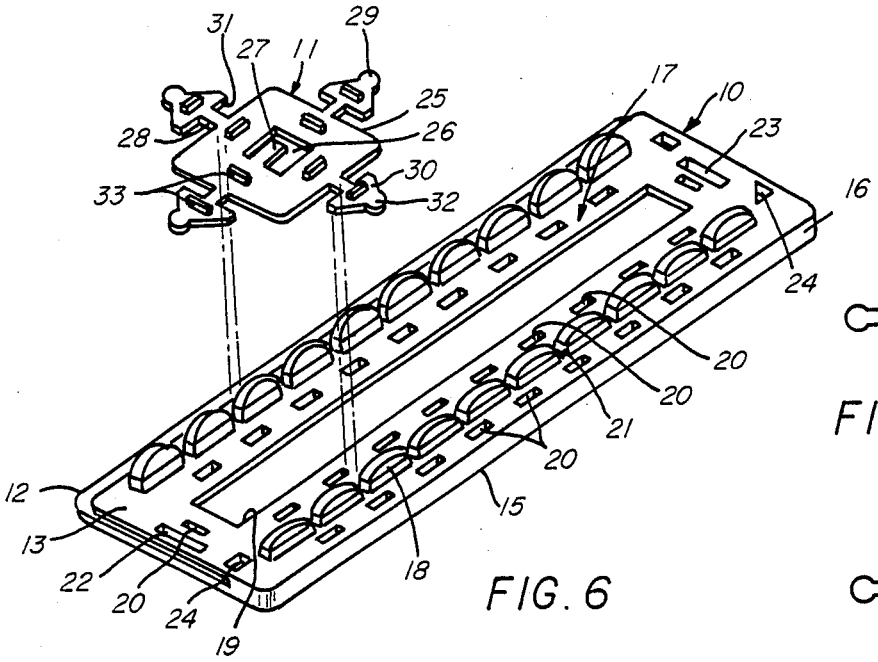
Figure 6A:
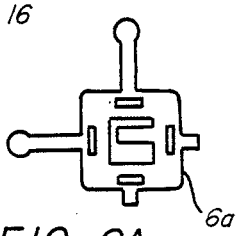
Figure 6B:
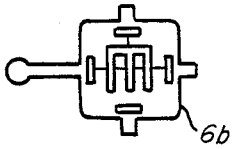
Figure 6C:
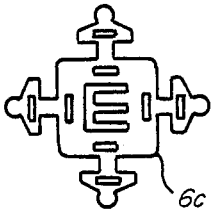
Figure 6D:
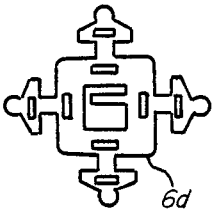
Figure 6E:
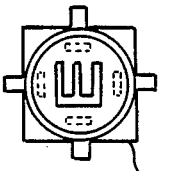
Figure 7:
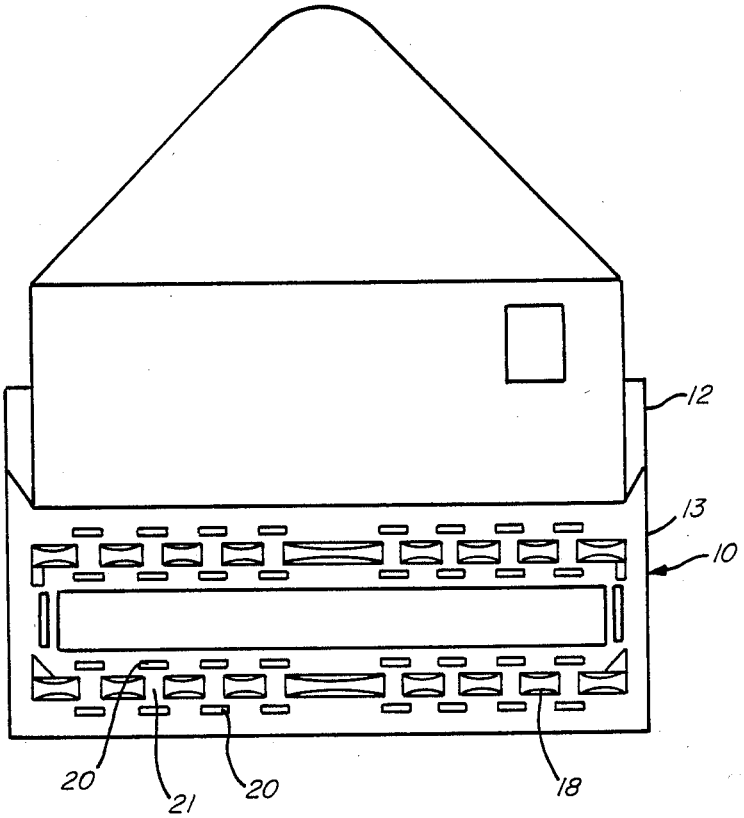
Figure 9A:
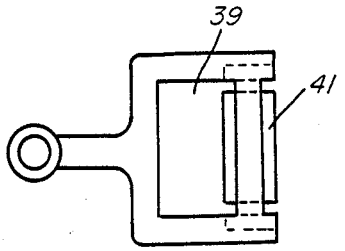
Figure 9B:
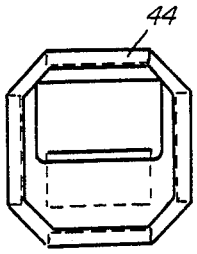
Figure 9C:
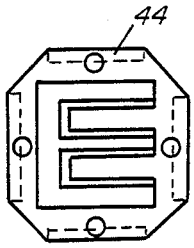
Figure 10A:
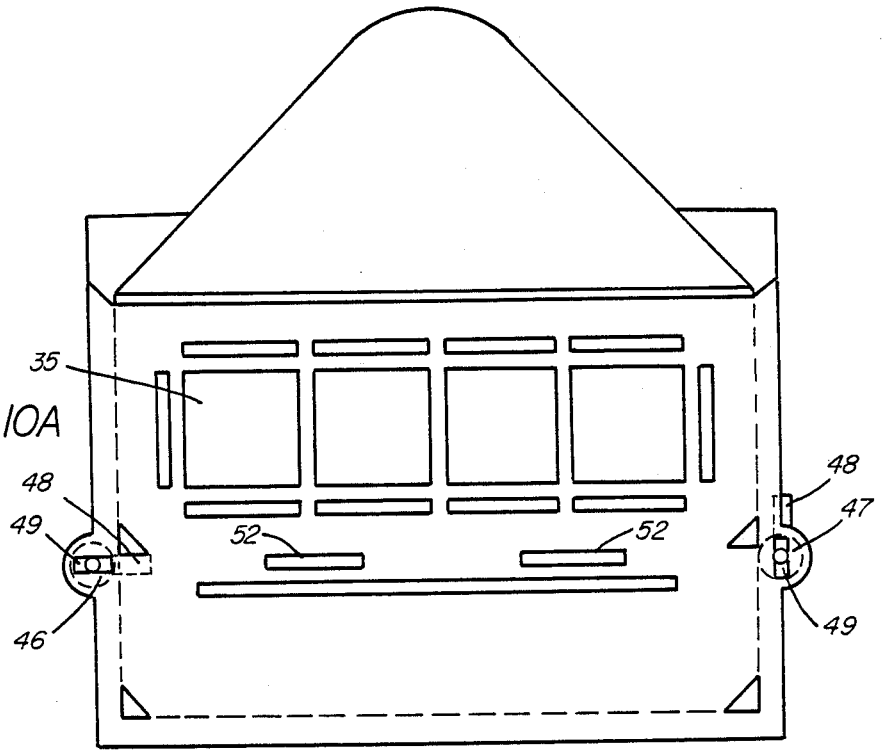
Figure 10B:
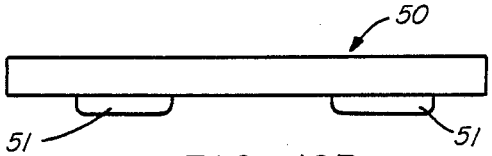
Figure 10C:
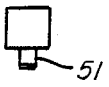

FIGS. 2(*a*) to 2(*d*) show how the single aperture evolves using twirler(s) from those with a plurality of apertures;

FIGS. 3(*a*) to 3(*e*) illustrate alternative units, each with a single character aperture, each aperture capable of forming all the letters of numbers corresponding to the grid of FIG. 1, FIG. 4 shows the unit of FIG. 3(*e*) presenting different orientations, and alongside each some of the various different characters which can be produced with the unit in each such orientation;

FIGS. 5(*a*), 5(*b*) and 5(*c*) each show another unit and the different fonts and characters which can be produced with those units, as examples only;

FIG. 5 shows a unit with five apertures for forming all the above fonts and characters shown;

FIG. 6 is an exploded perspective view of one embodiment of a handprint coding device according to the invention;

FIGS. 6(*a*) to (*e*) show various different movable units which could be used with the base unit of FIG. 6 or FIG. 7;

FIG. 7 is a plan view of a modified version of the embodiment shown in FIG. 6;

FIG. 8 is a plan view of a base unit of another embodiment of a handprint coding device according to the invention;

FIGS. 8(*a*) and (*b*) show various views of an alternate movable unit while FIGS. 8(*c*)–(*e*) show another alternative embodiment of a movable unit for use with the base unit of FIG. 8;

FIG. 9 is a plan view of a modified base unit of the embodiment shown in FIG. 8;

FIGS. 9(*a*) to (*c*) show three alternative movable units, in plan view, for use with the base unit of FIG. 9; and FIG. 10(*a*) is a plan view of a further modified base unit of the embodiment shown in FIG. 8, FIGS. 10(*b*) and 10(*c*) show end and side views of a thin strip equipped with stop members.

In the drawings, FIG. 1 illustrates the four contiguous quadrangles or quartered square or 5-unit grid 1 on which the National Physical Laboratory (NPL) or Epps-Evans (E-E) alphanumeric (A/N) font is based, and to which every such character destined for machine or optical character recognition (OCR) must strictly conform, as OCR has been simplified to detecting merely the presence or absence (P/A) of a line portion at the center of each of the grid's twelve segment positions, e.g. in FIG. 2, the line portions are shown present as at 1 or absent as at 2 in the first three NPL alphabetic characters, abc.

Leaving aside FIG. 3(*a*), which is very elementary, the various different units shown in FIGS. 3 to 5, all of which have only one single opening, can be used to form letters or numbers corresponding to the grid of FIG. 1 simply by rotating the units through 90° steps and/or turning the units over (twirling). These units will be referred to again later.

Referring to FIG. 6, the coding device comprises a base unit 10 and a movable unit 11. The base unit 10 has a lower plate-like member 12 supporting an upper plate-like member 13 and leaving a space between the members 12 and 13 sufficient to permit the insertion of any item to be coded, e.g, an envelope. The members are secured together along edges 15, 16 whereby the lower member supports the upper. A flat-based longitudinal trough 17 is located in the upper member 13 between upstanding walls 18. An elongate rectangular cut-out 19 is provided in the base of the trough 17 to serve as a writing path through which the envelope may be printed. Rectangular slots 20 are also located in the trough 17 at the sides of the writing path and in the upper member 13 on the outside of each wall 18 to help locate the movable unit 11 relative to the base unit in a manner which will become apparent later. Y-shaped vertical slots 21 (i.e. slots with divergent upper openings) are located in the walls 18 of the trough and extend down to the level of the base of the trough for a purpose which will become apparent later. The upper edge portions of both sides of the two walls 18 are also inclined to help guide the movable unit 11 down into the bottom of the trough 17. Slots 22, 23 are located in the trough at opposite ends of the cut-out 19 for making accurately spaced starter and end or calibration marks on the envelope to facilitate machine reading of the print. Viewing slots 24 are also located in the trough to facilitate positioning of the envelope between the upper and lower members.

The movable unit 11 has four sides 25 and a square cut-out 26 with a bar 27 extending into the cut-out. The movable unit 11 has a projection projecting outwardly from the center of each of its four sides. Each proJection comprises a stem 28 with a twirler 29 at its outer end. Each twirler has a wing portion 30 with an inner rectilinear edge 31 normal to the longitudinal extent of the stem 28 and a part circular portion 32. The movable unit 11 is also provided on both major surfaces with ridges 33 both adjacent to the cut-out and on the wing portions 30.

In order to locate the movable unit 11 in the base unit, the movable unit is placed in the trough 17 with two opposite stems 28 in aligned Y-shaped slots 21 in the two walls 18. The Y-shape of the slots 21 guides the stems 28 down into the slots 21 and this in turn guides the ridges 33 into corresponding slots 20. Opposite sides of the movable unit 11 abut the inner faces of the walls 18 of the trough and the rectilinear edges 31 on the wing portions of two of the twirlers abut the outer faces of the walls 18 of the trough. This, together with the location of the stems in the Y-slots and of the ridges in the slots 20, combine to locate the stencil rigidly and accurately on the base unit 10 for printing purposes. The movable unit may be orientated/rotated through 90°, 180° or 270° with respect to its orientation shown in FIG. 3 and the movable unit may be turned over (twirled) by holding one or two of the twirlers lightly between a finger and thumb externally—and moving the unit successively along the writing path, thus facilitating the use of the aperture 17 for printing all the desired characters on e.g., an envelope.

Thus, the coding device as shown in FIG. 6 enables a post code to be printed by hand on an envelope with unprecedented accuracy and precision to overcome the defects hitherto encountered in automatic machine recognition (OCR).

The various different movable units shown in FIGS. 6(*a*) to 6(*e*) can be used with the base unit of FIG. 6 and FIG. 7. FIG. 6(*d*) is a plan view of the movable unit shown in FIG. 6. FIG. 6(*c*) shows a movable unit with a single character opening of different shape. The movable units 6(*a*) to 6(*e*) of FIGS. 6(*a*), (*b*), (*c*), (*d*) and (*e*) respectively may all have four stems but not all stems have twirlers. FIG. 6(*e*) has no twirlers from any edge but, instead, holding and rotating means on its top surface encircle its character opening. Moreover, the latter has ridges on one face only.

The base unit of FIG. 7 is similar to that shown in FIG. 6 but the Y-shaped slots 21 and slots 20 are arranged to enable two groups each of four characters to be printed with a space between the two groups. This base unit is specifically for coding United Kingdom envelopes for mail mechanization.

The base unit 31 shown in FIG. 8 also has upper and lower plate-like members 32 and 33 respectively. The base unit 31 has three closed edges and an opening along the fourth edge to receive an envelope. Viewing slots 34 are provided to ensure correct alignment of the envelope in the holder. The base unit 31 has a row consisting of two groups each of four equi-distantly spaced open squares 35. Elongate slots 36 are provided above and below each open square 35 and at opposite ends of the row of open squares.

Two alternative movable units 37 and 38 are shown in FIGS. 8(*a*)–8(*b*) and 8(*c*)–(*e*) respectively. The movable unit 37 has an opening 39, a handle 40, a block 41 which fits within a chosen open square, and two short ridges 42 and 43 which fit in two of the slots 36 when the handle is orientated as shown with respect to the base unit 31, the ridge lengths and block widths being identical and equal to the combined widths of one bar and one slot in an opening. Alternatively, with the movable unit turned through 90° and the handle pointing towards the top or bottom of the base unit 31 the ridges 42 and 43 fit in two open squares adjoining the open square receiving the block 41 or in one such adjoining open square and one of the slots 36 at the ends of the row. With this arrangement the movable unit can be held firmly with respect to the base unit but slid fully against any side relative thereto in order that the opening 39 and a respective open square combine to enable any character to be printed. The movable unit 38 has no handle but is of cup-shape so that it can be handled and rotated as in FIG. 6(*e*). It has four ridges 44 on the lower surface of its base. The ridges are equal in length to the slots 36 and open squares 35 and fit in slots 30 above and below each open square 35 and in two open squares or in an open square and a slot at one end of the row to locate the movable unit relative to the base unit. The movable unit 38 also has on the lower surface of its base a block 45 which can be orientated as required in each of the squares 35 (or arranged to cover an appropriate part of each of the squares 35) to produce a row of precisely spaced characters.

The base unit of FIG. 9 is similar to that shown in FIG. 8 but it has two rows each comprising four equidistantly spaced open squares 35 and elongate slots 36 above each open square 35 of the top row and below each open square of the bottom row. Elongate slots 36, which may be considered unnecessary, are also provided between the two rows of open squares and at opposite ends of each row. The movable unit 9*a* shown in FIG. 9(*a*) is similar to that shown in FIG. 8(*a*)–8(*b*) whereas the movable units shown in FIGS. 9(*b*) and 9(*c*) have depending ridges 44 along each edge and no handle, but may have an octagonal projection or one to four separate projections from the top surface, preferably above the ridge positions, or, more centrally, from above the under block position, for rotating and handling.

It is very important, in order that reliable OCR can be performed on the printing, that the envelope does not move while the characters are being produced and it is envisaged that additional means of holding the envelope may be provided, such as one or more pads of high friction material pressing on the envelope near to a coded position.

The base unit shown in FIG. 10(*a*) is similar to that shown in FIG. 9 but has only one row of open squares 35. This base unit is, however, provided with retractable stop means 46 and 47 to locate matter to be printed in a partly inserted position in the base unit so that a first row of print can be provided and then upon retraction of the stop means 46, 47 to allow the matter to be printed to be further inserted in the base unit so that further rows of print can be provided parallel to the first row. The retractable stop means 46, 47 each comprise a stop 48 pivotably mounted on a side edge of the base unit for movement into and out of the space between the upper and lower members of the base unit by a knob or handle 49. In FIG. 10, the stop means 46 is shown in its envelope locating position, whereas the stop means 47 is shown in the position which allows the envelope to pass.

As a simpler alternative to the stop means 46 and 47, a thin strip 50 may be mounted in a holder, as shown in FIGS. 10(*b*) and 10(*c*). The illustrated example of the strip has two depending projections 51 engageable selectively with two slits 52 which may be located beneath the envelope positions in the top face of the upper member.

If envelopes or other matter onto which characters are to be printed are of such a color that it makes OCR difficult, the characters could be printed onto white self-adhesive labels fixed to the envelopes or other matter.

The openings in the movable units may be of various different shapes. Whilst only one single character opening is not only adequate but advantageous for coding purposes, a plurality of the same openings (differently profiled) may be utilized, if desired. Obviously, for more than a single font, more than one opening would provide greater variety than an ordinary typewriter. Some examples of the types of openings which can be provided in the movable unit are shown in FIGS. 3 to 5.

The unit 3*a* of FIG. 3(*a*) has vertical slots, which on 90° rotation produces the three horizontal slots of the NPL Grid, mainly for initial demonstration purposes.

The units 3*b* to 3*e* of FIGS. 3(*b*) to 3(*e*) and FIG. 4 have only one single aperture each, yet are all capable of printing not only all thirty-six NPL characters, but also many more, mainly upper case. The single apertures are all formed from an arrangement as shown in FIG. 3(*a*) by joining up two or three slots in different ways, to facilitate the formation of characters with fewer strokes.

The unit 5*a* of FIG. 5(*a*) can print all characters of the NEU alphabet illustrated.

The unit 5*b* of FIG. 5(*b*) has a single character aperture which can print the letters shown. These have internal diagonal or sloped segments to give greater variety to an alphabet.

The unit 5*c* of FIG. 5(*c*) can print the Cyrillic numerals illustrated (post codes are known which consist of numerals only).

Any object of whatever size or surface can be coded simply by coding appropriate white, self-adhesive slips, forms or labels for attachment thereto, where it could be read by a hand wand.

A handprint coding device embodying the invention permits the manual formation, whilst using only a single character aperture, of any alphabetic or numeric character in any one of a number of standardized, stylized fonts each based on a specific grid with un-precedented precision, not only in the character itself but also as regards character alignment, spacing and orientation, whilst requiring no pre-printed guides (or markers) of any kind without either the movable unit or an operator's fingers touching the area to be coded or the codes freshly printed thereon. Whilst a plurality of such character apertures may be used, if desired, the movable unit having only a single character aperture lends itself to a particularly high degree of stabilization as no part need ever protrude from either end of the base unit.

I claim:

1. A handprint stencil comprising:

(a) a base unit provided with:

(i) at least one opening in said base unit to provide a writing path, (ii) a substantially planar area adjacent said opening, (iii) a plurality of mating connections located on said planar area, said mating connections including abutment walls arrayed perpendicularly to the plane of said planar area, said walls being adapted to allow engagement of the plurality of mating connections only in a plane substantially perpendicular to said planar area; and (b) a movable unit having:

(i) at least one character aperture, and (ii) a set of mating connections extending perpendicularly to the plane of said movable unit, said set of mating connections being adapted for coupling releasably, perpendicular to the plane of said planar area and immovable, parallel to the plane of said planar area, with the plurality of mating connections on said base unit.

2. The stencil of claim 1, wherein said movable unit has four sides and wherein said mating connections on said movable unit includes stems, having a free end and an end attached to the movable unit, projecting outwardly from at least two opposite sides of said movable unit and said plurality of mating connections on said base unit includes vertical recesses disposed on opposite sides of said writing path to receive said stems on said movable unit.

3. The stencil of claim 2, wherein the base unit is provided with upstanding elongate walls on opposite sides of the writing path, the recesses being formed in the elongate walls.

4. The stencil of claim 2, wherein each recess in the elongate walls is shaped to operably guide a stem down to the bottom of said recess to securely hold the stem.

5. The stencil of claim 4, wherein the recesses are substantially Y-shaped vertical slots formed in the elongate walls.

6. The stencil of claim 2, wherein the recesses in the elongate walls are equi-distantly spaced apart from one another on each of the two opposite sides of each of said writing paths.

7. The stencil of claim 2, wherein at least one of the stems has a grip portion at the free end of said stem whereby the movable unit can be held with ease between a finger and thumb for twirling, rotating and coupling of the movable part with the base unit.

8. The stencil of claim 7, wherein each stem includes a grip portion, said grip portion including a wing portion having a rectilinear edge remote from the free end of the stem and normal to the longitudinal extent of the stem of said grip portion.

9. The stencil of claim 1, wherein the plurality of mating connections includes a flat-based longitudinal trough in the base unit for receiving the movable unit with a pair of opposite side edges of said movable unit in an abutting relationship with the sides of the trough.

10. The stencil of claim 9, wherein the upper edges of the two sides of the walls of the trough are inclined to operably guide the movable unit down to the bottom of the trough to securely hold the movable unit in place.

11. The stencil of claim 10, wherein the base unit is provided with upstanding elongate walls, the trough being defined between the upstanding elongate walls.

12. The stencil of claim 11, wherein the mating connections on said movable unit includes stems having a free end and an end attached to said movable unit and wherein said free ends include wing portions having rectilinear edges remote from the free end of the stem and normal to the longitudinal extent of the stem and wherein the rectilinear edges of the wing portions on the stems project outwardly from two opposite sides of the movable unit and are in an abutting relationship with those sides of the elongate walls remote from the respective writing path when the movable unit is held on the base unit.

13. The stencil of claim 1, wherein said mating connections comprise studs or ridges on one of said units and complementary holes or slots in the other unit.

14. The stencil of claim 13, wherein the holes or slots are provided in the base unit and the studs or ridges are provided on the movable unit.

15. The stencil of claim 14, wherein the writing path is provided with a border and at least some of the holes or slots are provided in the base unit along the borders of the writing path and at least some of the studs or ridges are provided on the movable unit in an area adjacent to the character aperture therein.

16. The stencil of claim 15, wherein at least some of the studs or ridges are provided on wing portions located on the mating connections of said movable unit, and said studs or ridges co-operate with holes or slots in the base unit positioned on that side of elongate walls remote from the respective writing path, said elongate walls being located on the base unit on opposite sides of the writing path.

17. The stencil of claim 1, wherein the base unit includes a lower member supporting an upper member above it, leaving a space between the two members for inserting matter to be stenciled, the upper member having a single square opening surrounded by slots, the movable unit having a projection pressable against any internal edge to permit forming the complete E-E font.

18. The stencil of claim 17, wherein the base unit is supplied with retractable stop means on each of the two opposite sides to locate matter to be printed in a partly inserted position in the space between the two members so that a first row of print can be provided and, upon retraction of the stop means, to allow the matter to be printed to be further inserted in the base unit so that further rows of print can be provided.

19. The stencil of claim 18, wherein the retractable stop means includes stops pivotably mounted on the base between the upper and lower members.

20. The stencil of claim 17, wherein the base unit has at least one row of slots on the surface thereof to receive stop members to locate matter to be printed in a partly inserted position in the base unit so that a first row of print can be provided and then upon retraction of the stop means to allow the matter to be printed to be further inserted in the base unit so that further rows of print can be provided where desired.

21. The stencil of claim 1, wherein the base unit includes a lower member for supporting an upper member above it, leaving a space between the two members for inserting matter to be stenciled the upper member having a row of identical, parallel, aligned, equally spaced square openings surrounded by slots, the movable unit having a projection pressable against any internal edge to permit the formation of the complete E-E font.

22. The stencil of claim 1, wherein there are at least eight character apertures in the movable unit.

23. The stencil of claim 1, wherein the movable unit has at least one character aperture, said aperture permitting the manual formation of any character in a selection of character fonts.

24. The stencil of claim 23, including a single aperture in a single movable unit said aperture being orientable to permit the formation of all the characters in a character font.

25. The stencil of claim 1, wherein the movable unit is provided with a plurality of different font apertures which permit formation of characters of more than one character font.

26. The stencil of claim 1, wherein the movable unit includes three parallel, equally spaced slots of equal lengths, the distance between the two outermost slots being substantially equal to the length of the slots.

27. The stencil of claim 26, further comprising a slot joining adjacent ends of the three slots.

28. The stencil of claim 26, further comprising two additional slots, one of said additional slots joining the adjacent ends of two adjacent slots, and the other additional slot joining the opposite ends of two other adjacent slots.

29. The stencil of claim 1, wherein the movable unit includes a substantially square aperture with two parallel slots extending in opposite directions from each of two diagonally opposite corners of the substantially square aperture.

30. The stencil of claim 1, wherein the movable unit includes an aperture formed by two, parallel slots of equal length whose spacing is equal to the length of the slots, a diagonal slot joining the two slots at opposite ends, and a generally triangular cut-out portion defined by a diagonal edge extending between one end of the parallel slots and substantially the center of the diagonal slot.

31. The stencil of claim 1, wherein the movable unit is provided with an aperture comprising three equally spaced parallel slots, a common slot at right angles to the three parallel slots and joining the three slots at one end, and two substantially identical generally triangular cut-out portions defined by two parallel edges extending from the end of a respective parallel slot adjacent to the common slot to the opposite end of the adjacent parallel slot.

32. The stencil of claim 1, wherein there are less then eight character apertures in the movable unit.

* * * * *